US006655779B2

(12) United States Patent
Usui et al.

(10) Patent No.: US 6,655,779 B2
(45) Date of Patent: Dec. 2, 2003

(54) JUDGEMENT ON COMPATIBILITY BETWEEN INK CARTRIDGES AND PRINTING APPARATUS

(75) Inventors: Kiyofumi Usui, Nagano-ken (JP); Hideto Matsuzaka, Nagano-ken (JP); Kazuo Koshino, Nagano-ken (JP); Toshihisa Saruta, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/992,030

(22) Filed: Nov. 26, 2001

(65) Prior Publication Data

US 2002/0075344 A1 Jun. 20, 2002

(30) Foreign Application Priority Data

Nov. 28, 2000 (JP) ..... 2000-361280
Nov. 21, 2001 (JP) ..... 2001-355908

(51) Int. Cl.[7] ..... B41J 29/393; B41J 2/165
(52) U.S. Cl. ..... 347/19; 347/23
(58) Field of Search ..... 347/19, 14, 10, 347/11, 12, 7, 23, 86, 85, 5, 20, 87, 49; 358/298, 296

(56) References Cited

U.S. PATENT DOCUMENTS 5,610,635 A * 3/1997 Murray et al. ..... 347/7
5,638,097 A * 6/1997 Takayanagi et al. ..... 347/7
6,361,138 B1 * 3/2002 Seino et al. ..... 347/19

FOREIGN PATENT DOCUMENTS

JP 2000-198220 7/2000

* cited by examiner

*Primary Examiner*—Stephen D. Meier
*Assistant Examiner*—Charles W. Stewart, Jr.
(74) *Attorney, Agent, or Firm*—Oliff & Berridge, PLC

(57) ABSTRACT

The object of the present invention is to provide a technique that flexibly determines compatibility of an ink cartridge with a printing apparatus with high accuracy.

The ink cartridge has a storage element that stores therein compatible driver information, which is used to specify a printer driver compatible with the ink cartridge. The printing apparatus collates information of a selected printer driver with the compatible driver information and determines compatibility of the ink cartridge with the printer driver. The printer driver changes over the method of generating print data, based on the compatible driver information.

18 Claims, 12 Drawing Sheets

Fig. 3

| | Contents of Information | |
|---|---|---|
| 201 | Remaining Quantity Data of Cyan Ink | 230 |
| 202 | Remaining Quantity Data of Cyan Ink | |
| 203 | Remaining Quantity Data of Magenta Ink | |
| 204 | Remaining Quantity Data of Magenta Ink | |
| 205 | Remaining Quantity Data of Yellow Ink | |
| 206 | Remaining Quantity Data of Yellow Ink | |
| 207 | Remaining Quantity Data of Light Cyan Ink | |
| 208 | Remaining Quantity Data of Light Cyan Ink | |
| 209 | Remaining Quantity Data of Light Magenta Ink | |
| 210 | Remaining Quantity Data of Light Magenta Ink | |
| 211 | Unsealed Time Data(Year) | 240 |
| 212 | Unsealed Time Data(Month) | |
| 213 | Version Data of Ink Cartridge | |
| 214 | Ink Type Data | |
| 215 | Year-of-Manufacture Data | |
| 216 | Month-of-Manufacture Data | |
| 217 | Date-of-Manufacture Data | |
| 218 | Production Line Data | |
| 219 | Serial Number Data | |
| 220 | Recycle Data | |
| 221 | Compatible Driver Information | |

| | Driver A | Driver B | Driver C | Driver D |
|---|---|---|---|---|
| Version 1 | Incompatible | Incompatible | Optimum | Incompatible |
| Version 2 | Allowed | Optimum | Compatible | Incompatible |
| Version 3 | Optimum | Compatible | Incompatible | Incompatible |
| Version 4 | Compatible | Allowed | Allowed | Incompatible |
| Version ? | Incompatible | Incompatible | Incompatible | Incompatible |

Fig. 4

Fig. 10

| | Contents of Information | |
|---|---|---|
| 201 | Remaining Quantity Data of Ink | 230C |
| 202 | Remaining Quantity Data of Ink | |
| 203 | Color Information : Cyan | 240C |
| 204 | Unsealed Time Data (Year) | |
| 205 | Unsealed Time Data(Month) | |
| 206 | Version Data of Ink Cartridge | |
| 207 | Ink Type Data | |
| 208 | Year-of-Manufacture Data | |
| 209 | Month-of-Manufacture Data | |
| 210 | Date-of-Manufacture Data | |
| 211 | Production Line Data | |
| 212 | Serial Number Data | |
| 213 | Recycle Data | |
| 214 | Compatible Driver Information | |

Fig. 11

| | Ink Cartridges | | | | | | | | Versions of Printer Driver | | | | |
|---|---|---|---|---|---|---|---|---|---|---|---|---|---|
| | 1 | 2 | 3 | 4 | 5 | 6 | 7 | 8 | 1.00 | 1.01 | 1.02 | 1.10 | 1.11 |
| SET1 | K | K | C | LC | M | LM | Y | Y | Optimum | Compat-ible | Allowed | Allowed | Incompat-ible |
| SET2 | K | K | C | LC | M | LM | Y | DY | Compat-ible | Optimum | Compat-ible | Allowed | Allowed |
| SET3 | K | LK | C | LC | M | LM | Y | DY | Allowed | Compat-ible | Optimum | Compat-ible | Allowed |
| SET4 | K2 | K2 | C | LC | M | LM | Y | Y | Allowed | Allowed | Compat-ible | Optimum | Compat-ible |
| SET5 | K2 | K2 | C | LC | M | LM | Y | DY | Incompat-ible | Allowed | Allowed | Compat-ible | Optimum |

JUDGEMENT ON COMPATIBILITY BETWEEN INK CARTRIDGES AND PRINTING APPARATUS

FIELD OF THE INVENTION

The present invention relates to a technique of judging compatibility between ink cartridges and a printing apparatus.

DESCRIPTION OF THE RELATED ART

The ink jet printer generally carries out printing with ink supplied from an ink cartridge. Different ink cartridges have different contours and keep inks of different compositions. Selection of an ink cartridge that has the contour attachable to a specified printer but is incompatible with the printer gives unsatisfactory printing results. In order to prevent such a potential problem, various techniques have been proposed to determine the compatibility of the ink cartridge with the printer.

A proposed ink cartridge has a memory that stores therein various pieces of information including a production code of the ink cartridge. A list of compatible ink cartridges is stored in advance in the printer to which this ink cartridge is attached. The printer collates data read from the memory included in the ink cartridge with the list and thereby determines the compatibility of the ink cartridge with the printer, that is, whether or not the ink cartridge is applicable for the printer.

Another proposed technique provides a print head of the printer with ID information. The ID information of available print heads is stored in advance in a memory included in the ink cartridge. The printer determines the compatibility by collation of the ID information.

In the former technique, however, the list stored in the printer is provided as part of the firmware, and in many cases, the user does not update the list. The printer may thus determine that a newly developed ink cartridge without the production code in the list is unusable, even when the ink cartridge is actually compatible. Design of the list by taking into account the production codes of future ink cartridges certainly prevents this problem, but allocation of the production codes becomes undesirably complicated.

The latter technique allows even a newly developed ink cartridge to be applied to the old-type printer. The printing result, however, does not depend upon only the specification of the print head and the other hardware construction. Attachment of the newly developed ink cartridge to the printer having the compatible hardware may not give the favorable printing result, when the selected version of the printer driver is not compatible with the ink cartridge.

SUMMARY OF THE INVENTION

The object of the present invention is thus to solve the problems discussed above and to provide a technique of flexibly determining compatibility of an ink cartridge with a printing apparatus with high accuracy.

In order to attain at least part of the above and the other related objects, the present invention is directed to an ink cartridge attachable to a printing apparatus. The ink cartridge has a storage element that stores therein compatible driver information, which is used to specify a printer driver compatible with the ink cartridge.

The printer driver is designed according to the specification of the printing apparatus and the ink kept in the ink cartridge attached to the printing apparatus. Collation of the printer driver used for printing with the compatible driver information specifies the software compatibility of the ink cartridge with the printing apparatus to which the ink cartridge is attached. In the structure of the present invention, the compatible driver information is stored in the in cartridge. This arrangement enables the latest information relating to the compatibility to be provided even with regard to any newly developed ink cartridge, thus ensuring appropriate determination of compatibility.

Diverse procedures are applicable for the operation of the printing apparatus after the determination of compatibility. For example, in the case of 'incompatible', the printing operation may be prohibited, or installation of a preferable printer driver may be suggested. Another applicable procedure informs the user of the incompatible combination and entrusts the user with determination of forcible execution or non-execution of the printing operation.

In the ink cartridge of the present invention, it is preferable that the compatible driver information includes version information of the printer driver.

The printer driver may be subjected to version up for the purpose of enhancing the printing quality. In such cases, application of the ink cartridge of the present invention desirably enables determination of compatibility of the ink cartridge with the new version of the printer driver.

In the ink cartridge of the present invention, it is also preferable that the compatible driver information includes prohibition information to specify at least one of a printing apparatus and a printer driver, for which use of the ink cartridge is prohibited.

In the case where the ink cartridge is incompatible with the printing apparatus, the forcible execution of printing may significantly worsen the printing quality or may cause fatal troubles to arise in the printing apparatus. For example, application of pigment ink to a print head for dye ink may cause the print head to be clogged. In such cases, application of the present invention positively prohibits the use of the ink cartridge that may cause fatal troubles.

In accordance with one preferable embodiment of the ink cartridge of the present invention, the compatible driver information expresses compatibility of the ink cartridge with multiple printer drivers in a stepwise manner.

For example, it is assumed that the respective combinations of the ink cartridge with the printer driver have the following relations. The combination with the printer driver of version 4 is optimum (that is, attaining the highest printing quality). The combination with the version 3 is compatible, though not being so suitable as the combination with the version 4. The combination with the version 2 is allowed with a little deterioration of the printing quality. The combination with the version 1 significantly worsens the printing quality. In this case, the ink cartridge of the present invention is applied to specify the degree of compatibility with the printer driver and inform the user of the presence of another printer driver having the higher compatibility. Application of the printer driver that is capable of selecting a processing specification and parameters among a plurality of options in the course of generating print data from master image data enables the details of the processing to be changed according to the information read from the storage element included in the ink cartridge.

In the above embodiment of the ink cartridge, the compatible driver information may store a mapping of the ink cartridge to multiple printer drivers with regard to each printing apparatus. This arrangement ensures application of the ink cartridge to a plurality of different printing apparatuses.

In the structure of the present invention, a plurality of different inks may be kept collectively in one ink cartridge.

In one preferable embodiment, the ink cartridge keeps one ink, and the storage element further stores therein ink specification information, which is used to specify the ink kept in the ink cartridge.

In the ink cartridge of the above embodiment, the ink specification information may include color information of the ink.

The ink specification information may include composition information of the ink.

The color information is, for example, the name of color like cyan, magenta, yellow, or black. The composition information regards, for example, the composition of ink like dye ink or pigment ink. When there are inks of an identical hue but different compositions, identification information for discriminating the compositions from each other is included in the composition information.

In the above arrangement of the present invention, the compatible driver information for specifying the compatible printer drivers is stored in the storage element included in each of ink cartridges that keep inks of diverse colors and components. This arrangement ensures determination of compatibility according to the ink kept in each ink cartridge.

In the structure of the present invention where the ink cartridge keeps one ink, the printing apparatus is capable of receiving a plurality of the ink cartridges attached thereto, and the compatible driver information specifies a printer driver corresponding to a combination of ink cartridges attached to the printing apparatus.

There are various combinations when the plurality of ink cartridges are attached to the printing apparatuses. The process of generating optimum print data, that is, the printer driver, depends upon the combination of ink cartridges. For example, print data to be generated in the case of printing with six color inks, cyan, light cyan, magenta, light magenta, yellow, and black is different from the print data in the case of printing with dark yellow and light black inks in addition to the six color inks. When a novel ink cartridge is developed to keep ink of any different color or composition from the conventional color or composition, the printer driver is generally updated according to the characteristics of the ink. In the above arrangement of the present invention, the adequate printer driver is specified corresponding to the combination of ink cartridges attached to the printing apparatus. This ensures flexible determination of compatibility with higher accuracy.

Another application of the present invention is a printing apparatus, to which the ink cartridge described above is attached.

The present invention is accordingly directed to a printing apparatus that records an image on a printing medium. The printing apparatus includes: a main body storage unit that stores therein printer driver information, which is applied to specify a printer driver used for printing; an input module that reads a predetermined piece of information from a storage element included in an ink cartridge attached to the printing apparatus; and a compatibility determination module that collates the input information with the printer driver information stored in the main body storage unit and determines compatibility of the ink cartridge with the printer driver.

The 'predetermined piece of information' may be the compatible driver information discussed above. Such information ensures determination of whether the ink cartridge is compatible or incompatible with the selected printer driver.

In accordance with one preferable application of the printing apparatus of the present invention, the main body storage unit further stores compatible driver information, which is used to specify a printer driver compatible with the ink cartridge, and the compatibility determination module carries out the determination, based on the compatible driver information.

The 'predetermined piece of information' stored in the storage element of the ink cartridge may not include the compatible driver information. In such cases, the arrangement of the above application ensures determination of whether the ink cartridge is compatible or incompatible with the selected printer driver. The compatible driver information stored in the main body storage unit may be supplied from a recording medium like a flexible disk or a CD-ROM or from a specific server that is connectable with the printing apparatus via a network.

In accordance with another preferable application of the present invention, the printing apparatus is capable of receiving a plurality of the ink cartridges attached thereto. The input module reads the predetermined piece of information from each of storage elements included in the plurality of ink cartridges, and the compatibility determination module carries out the determination, based on a combination of the predetermined piece of information.

This arrangement ensures flexible determination of compatibility or incompatibility of the ink cartridge with the selected printer driver with high accuracy, based on the combination of ink cartridges.

Still another application of the present invention is a print control apparatus that generates print data, which causes a printing module (printer) of the printing apparatus, to which the ink cartridge is attached, to print an image.

The present invention is accordingly directed to a print control apparatus that processes master image data and thereby generates print data, which causes a printer to print an image. The print control apparatus includes: an input module that reads a predetermined piece of information from a storage element included in an ink cartridge attached to the printer; and a processing control module that changes over a method of generating the print data, based on the input information.

The print control apparatus of the present invention is capable of generating print data according to a plurality of different procedures. For example, the printer driver of version 4 may be constructed to enable execution of the processing corresponding to any of the lower versions 1 through 3. The printer driver of such construction can adequately change over the processing mode according to the type of the ink cartridge. For example, in the case of installation of the printer driver of version 4, it is presumed that the information specifying the printer driver of version 3 as the optimum version is read from the ink cartridge. In this case, the print control apparatus of the present invention enables the printer driver of version 4 to carry out processing corresponding to the version 3. The selective application of the processing mode ensures generation of the optimum print data corresponding to the ink cartridge.

In accordance with one preferable application of the print control apparatus of the present invention, the printer is capable of receiving a plurality of the ink cartridges attached thereto. The input module reads the predetermined piece of information from each of storage elements included in the plurality of ink cartridges, and the processing control module carries out the changeover, based on a combination of the predetermined piece of information.

This arrangement changes over the series of processing corresponding to the combination of multiple ink cartridges, thus ensuring adequate generation of print data.

The technique of the present invention is also actualized by a method of controlling the printing apparatus and a print control method, in addition to the ink cartridge, the printing apparatus, and the print control apparatus discussed above. The present invention is further attained by a diversity of other applications including computer programs for actualizing these apparatuses or methods, recording media in which such computer programs are recorded, and data signals that include such computer programs and are embodied in carrier waves. The variety of additional factors described above are given to any of these applications.

When the technique of the present invention is attained by a computer program or a recording medium in which the computer program is recorded, the application may be the whole program for driving the printing apparatus or only part of the program that attains the functions of the present invention. Typical examples of the recording medium include flexible disks, CD-ROMs, magneto-optic discs, IC cards, ROM cartridges, punched cards, prints with barcodes or other codes printed thereon, internal storage devices (memories like a RAM and a ROM) and external storage devices of the computer, and a variety of other computer readable media.

BRIEF DESCRIPTION OF THE DRAWINGS

FIG. 3 shows an exemplified data array in a storage element 80 included in the ink cartridge 100;

FIG. 4 shows an example of the contents of compatible driver information in the first embodiment;

FIG. 10 shows an exemplified data array in a storage element 80C included in a cyan ink cartridge 100C;

FIG. 11 shows an example of the contents of the compatible driver information in the third embodiment.

DESCRIPTION OF THE PREFERRED EMBODIMENTS

Figure 1:
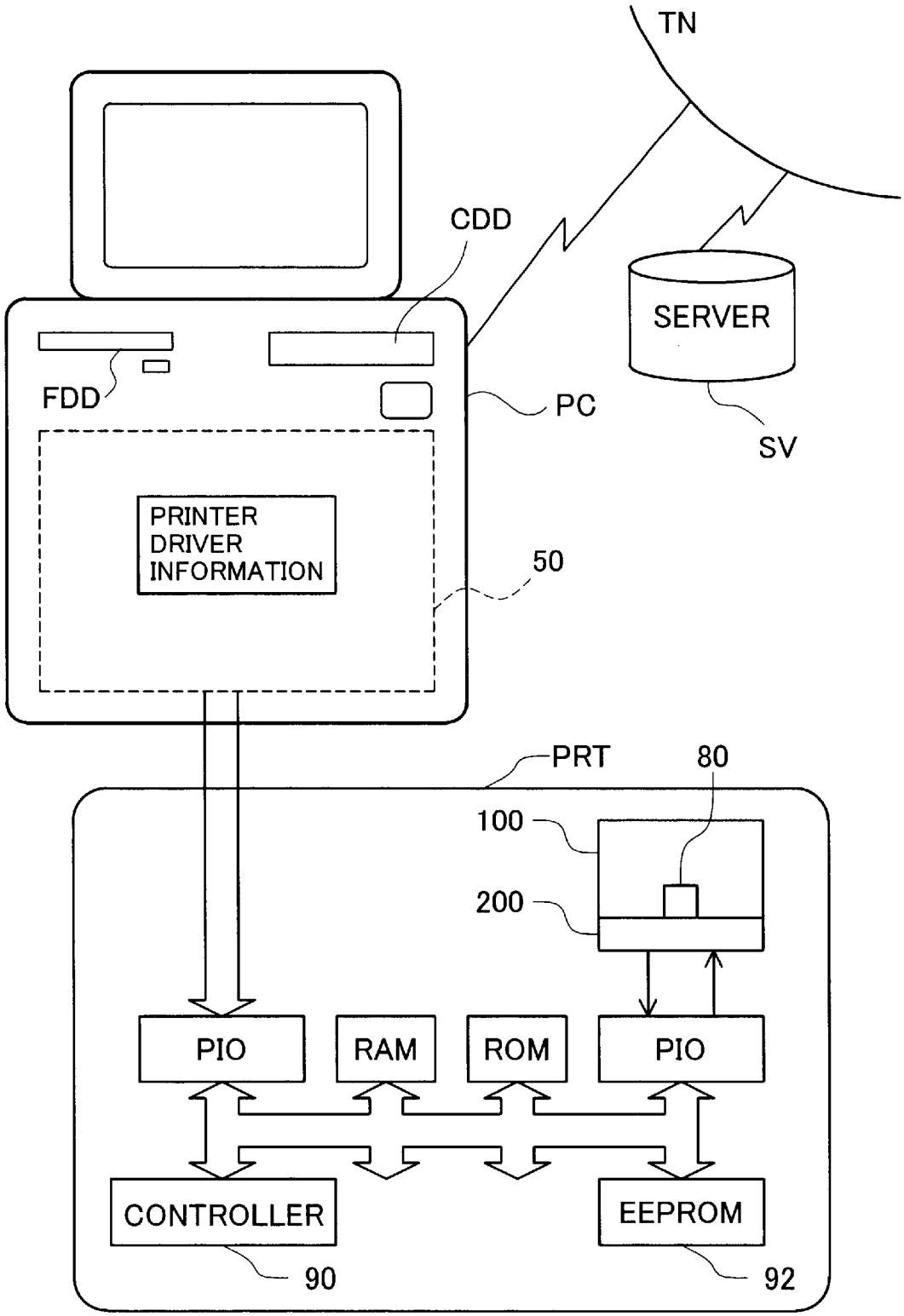
FIG. 1 is a block diagram illustrating the structure of a printing system in a first embodiment of the present invention.

Some modes of carrying out the present invention are described below as preferred embodiments in the following sequence:

A. Structure of Printing Apparatus
B. Ink Cartridge
C. Determination of Compatibility of Ink Cartridge
D. Second Embodiment
E. Third Embodiment
F. Modifications A. Structure of Printing Apparatus FIG. 1 is a block diagram illustrating the structure of a printing system in a first embodiment of the present invention. The printing system includes a computer PC functioning as a print control apparatus, and a printer PRT.

In the computer PC, a non-illustrated application program works under a predetermined operating system. The application program carries out various series of processing, such as generation of images and retouching. A printer driver 50 is incorporated in the operating system. The printer driver 50 corresponds to a program that attains the function of generating print data, which includes sub-scan feed data and raster data representing the dot recording state in each pass of main scan.

The printer driver 50 receives image data from the application program and generates print data to be supplied to the printer PRT, based on the input image data. The printer driver 50 generates print data through color conversion and halftoning processes. Printer driver information including version information is attached to the printer driver 50.

The color conversion process refers to a color conversion table and converts one color system of red (R), green (G), and blue (B) applied for master image data into another color system of cyan (C), light cyan (LC), magenta (M), light magenta (LM), yellow (Y), and black (K) adopted in the printer PRT. The halftoning process causes the tone values of image data to be expressed by a distribution of dots. Part of the processing executed in the printer driver 50 may alternatively be carried out in the printer PRT.

Programs attaining the functions of the respective modules in the printer driver 50 are supplied in a form recorded in a computer readable recording medium. Typical examples of the recording medium include flexible disks, CD-ROMs, magneto-optic discs, IC cards, ROM cartridges, punched cards, prints with barcodes or other codes printed thereon, internal storage devices (memories like a RAM and a ROM) and external storage devices of the computer, and a variety of other computer readable media.

The computer PC is connected to an external network TN. Connection of the computer PC with a specific server SV enables a program and data required for driving the printer PRT to be downloaded. The whole program required for printing may be loaded collectively, or only required part of the functions may be loaded as modules.

The printer PRT is connected to the computer PC and receives the print data, which is generated by the printer driver 50 in the computer PC, to carry out printing. The printer PRT includes a controller 90 having a CPU, a RAM, a ROM, a parallel input-output interface PIO, and an EEPROM 92. After installation of the printer driver 50 in the computer PC, printer driver information is stored into the EEPROM 92 at the time of first communication with the printer PRT. The printer PRT has a carriage 200 for main scan of a non-illustrated print head. An ink cartridge 100 with a storage element 80 is attached to the carriage 200. The carriage 200 has a contact for reading information from the storage element 80. The information stored in the storage element 80 is read out and stored into the EEPROM 92 when the ink cartridge 100 is attached to the carriage 200. The controller 90 determines compatibility of the ink cartridge with the printer driver according to a program stored in the ROM, as discussed later.

B. Ink Cartridge

Figure 2:
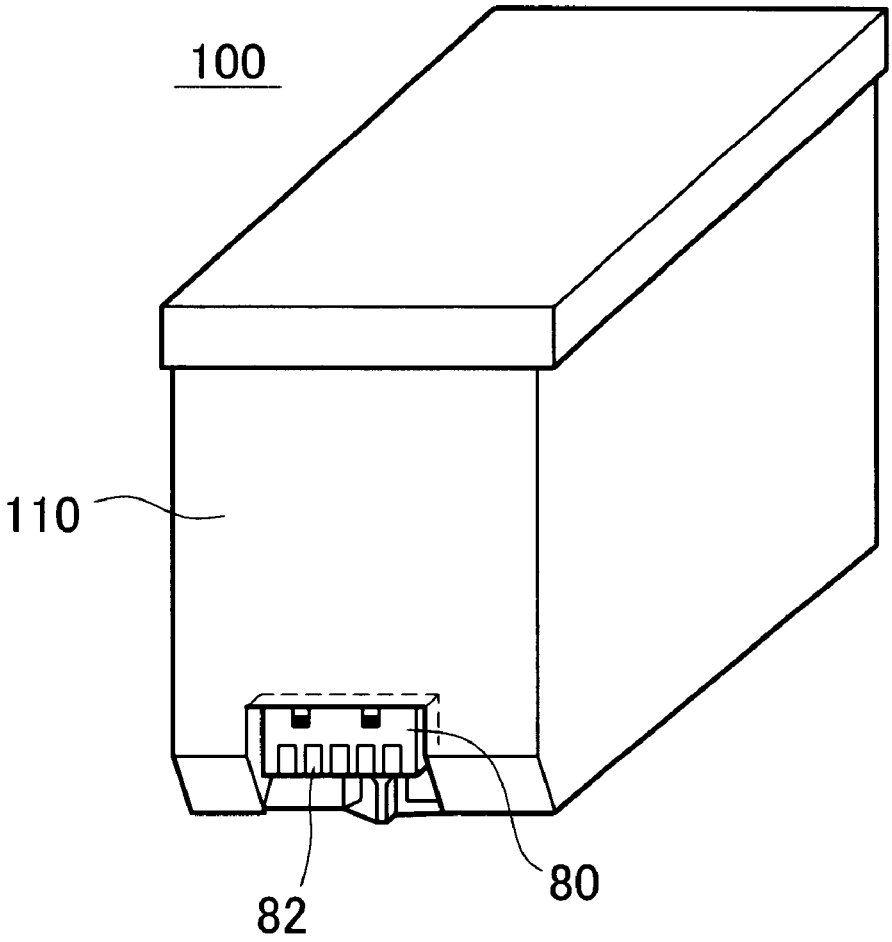
FIG. 2 is a perspective view schematically illustrating the structure of an ink cartridge 100.

FIG. 2 is a perspective view schematically illustrating the structure of the ink cartridge 100. The ink cartridge 100 keeps five color inks, cyan, light cyan, magenta, light magenta, and yellow therein. The ink cartridge 100 has a cartridge main body 110 for accommodating inks therein and the storage element 80 for storing compatible driver information and remaining quantities of inks described later. While the storage element 80 is mounted on the carriage 200 in the printer PRT, multiple contact terminals 82 on the ink cartridge 100 are in contact with non-illustrated multiple contact terminals of the carriage 200 to allow transmission of various data between the storage element 80 and the printer PRT. In another available structure, the data transmission to and from the storage element 80 is carried out in a non-contact manner.

FIG. 3 shows an exemplified data array in the storage element 80 included in the ink cartridge 100. The memory cell of the storage element 80 has a first area 240 in which read only data is stored, and a second area 230 in which rewritable data is stored.

The first area 240 stores therein sealed time data (year) of the ink cartridge 100, sealed time data (month) of the ink cartridge 100, version data of the ink cartridge 100, ink type data showing either dye ink or pigment ink, year-of-manufacture data of the ink cartridge 100, month-of-manufacture data of the ink cartridge 100, date-of-manufacture data of the ink cartridge 100, production line data of the ink cartridge 100, and serial number data of the ink cartridge 100, recycle data showing whether the cartridge main body 110 is new or recycled, and compatible driver information showing a list of compatible printer drivers. The compatible driver information will be discussed later in detail. These data are read by the printer PRT when the ink cartridge 100 is attached to the printer PRT.

The second area 230 stores therein remaining quantity data of cyan ink, remaining quantity data of magenta ink, remaining quantity data of yellow ink, remaining quantity data of light cyan ink, and remaining quantity data of light magenta ink. Two storage spaces are allocated to the remaining quantity data of each ink. The remaining quantity data of each ink is alternately written into these two storage spaces.

FIG. 4 shows an example of the contents of the compatible driver information in this embodiment. The compatible driver information shows the compatibility of various versions of diverse printer drivers with the ink cartridge in the form of a table. The printer driver is generally provided in one-to-one mapping to each type of the printer, so that the printer driver name may be synchronous with the printer type name.

In this embodiment, the compatibility is expressed by four levels, 'optimum', 'compatible', 'allowed', and 'incompatible'. The level 'optimum' means that the combination of a specific version of a printer driver with the ink cartridge ensures sufficiently favorable picture quality. The levels 'compatible' and 'allowed' mean that the combination allows the normal printing operation with a little deterioration of the picture quality. The picture quality is lowered in the order of the levels 'optimum', 'compatible', and 'allowed'. In the combinations having the level 'incompatible', the printing quality is significantly worsened due to a difference in processing for generating the print data, or there is a fear that a significant trouble may occur in the printer. The level 'incompatible' accordingly prohibits use of the ink cartridge in the corresponding combination.

For example, it is here assumed that the ink cartridge 100 is attached to a printer using a printer driver A. According to this table, the combination with version 3 of the printer driver A shows the 'optimum' level. The combination with version 4 shows the 'compatible' level, though not so suitable as the combination with the version 3. The combination with version 2 shows the 'allowed' level with a little deterioration of the picture quality. The combination with version 1 shows the 'incompatible' level. The combination with an unknown version ('version ?') also shows the 'incompatible' level. Similar relations are given in the case where the ink cartridge 100 is attached to another printer using a printer driver B or a printer driver C. When the ink cartridge 100 is attached to a printer using a printer driver D, all the combinations with any versions of the printer driver D show the 'incompatible' level. This practically means that the ink cartridge 100 is not usable for the printer corresponding to the printer driver D.

C. Determination of Compatibility of Ink Cartridge

Figure 5:
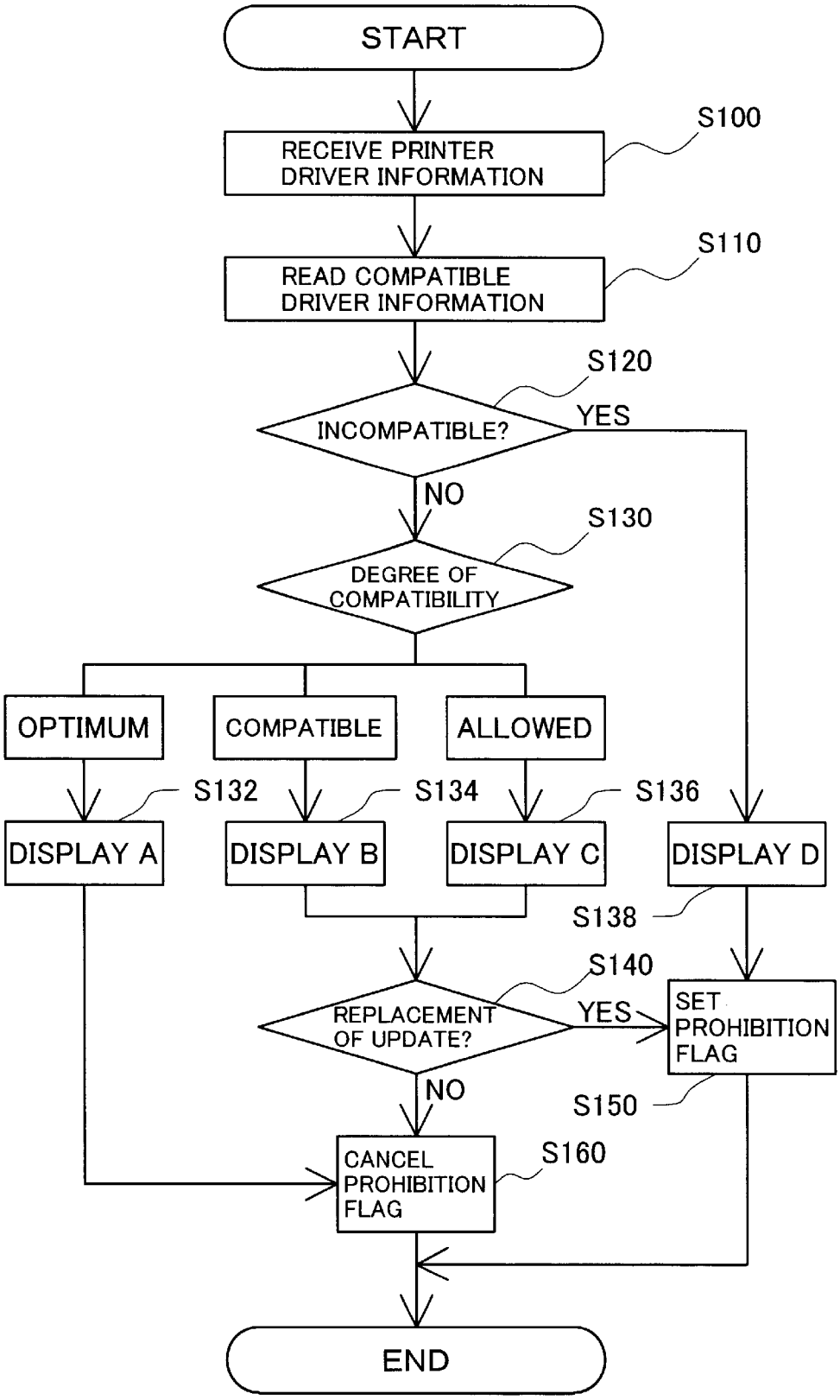
FIG. 5 is a flowchart showing a routine of determining the compatibility of the ink cartridge 100 with the printer (printer driver)

FIG. 5 is a flowchart showing a routine of determining the compatibility of the ink cartridge 100 with the printer (printer driver). The CPU of the controller 90 in the printer PRT executes this processing routine when the ink cartridge 100 is attached to the carriage 200.

The CPU first receives the printer driver information stored in the EEPROM 92 of the printer PRT (step S100), and reads the compatible driver information from the storage element 80 included in the ink cartridge 100 (step S110). The CPU then collates the printer driver information with the compatible driver information and determines whether or not the current combination is incompatible (step S120).

In the case of 'incompatible', the CPU gives a display D representing the 'incompatible' level and requires the user to replace the ink cartridge or to update or change the printer driver (step S138), and sets a prohibition flag in the EEPROM 92 (step S150). Setting the prohibition flag prohibits the operations of the printer.

In the case of not 'incompatible' at step S120, the CPU specifies the degree of compatibility (step S130). In the case of 'optimum', the CPU gives a display A representing the 'optimum' level (step S132) and cancels the prohibition flag set in the EEPROM 92 (step S160).

In the case of 'compatible', the CPU gives a display B representing the 'compatible' level but suggesting there may be a better combination with another version of the printer driver or with another printer driver (step S134), and asks the user whether printing is forcibly executed or not executed in the current combination (step S140). In the case of the user's selection of non-execution of printing in the current combination, that is, when the user determines replacement of the ink cartridge or update or change of the printer driver, the CPU sets the prohibition flag in the EEPROM 92 (step S150). The printing operation is accordingly not allowed until at least either of the replacement of the ink cartridge or update or change of the printer driver is completed. In the case of the user's selection of forcible execution of printing in the current combination, on the other hand, that is, when the user determines no replacement of the ink cartridge and no update or change of the printer driver, the CPU cancels the prohibition flag set in the EEPROM 92 (step S160).

In the case of 'allowed', a similar series of processing (steps S136, S140, S150, and S160) to that in the case of 'compatible' is carried out. A display C given at step S136 shows that the use of the ink cartridge is allowed but not recommended and that there may be a better combination with another version of the printer driver or with another printer driver. The display C in the case of 'allowed' has the stronger warning tendency than the display B in the case of 'compatible'.

As discussed above, in the structure of the first embodiment, the ink cartridge 100 stores the compatible driver information. The CPU in the printer reads the compatible driver information and collates the compatible driver information with the installed printer driver information. The CPU thus comprehensively determines the software compatibility of the ink cartridge with the printer driver as well as the hardware compatibility of the ink cartridge with the printer main body. This arrangement effectively prevents the potential troubles due to the incompatible combination of the ink cartridge with the printer driver. The compatible driver information is stored in the storage element 80 included in the ink cartridge 100. The adequate determination of the compatibility is thus attained for even newly developed ink cartridges.

D. Second Embodiment

Figure 6:
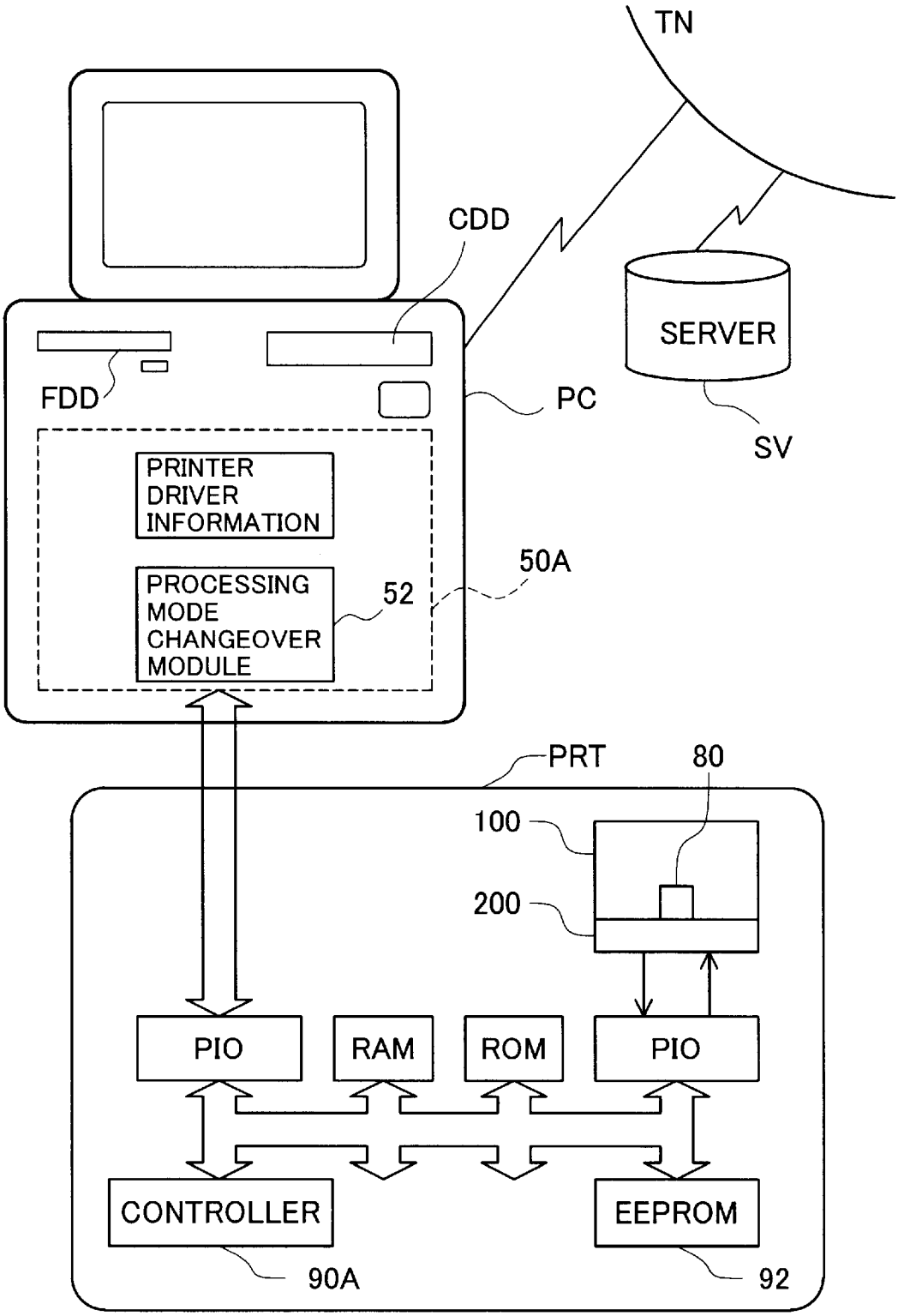
FIG. 6 is a block diagram illustrating the structure of another printing system in a second embodiment of the present invention.

FIG. 6 is a block diagram illustrating the structure of another printing system in a second embodiment of the present invention. In the structure of the second embodiment, a printer driver 50A incorporated in the computer PC is capable of selectively carrying out processing of lower versions. For example, the printer driver of version 4 generally carries out the respective series of processing with color conversion tables and halftoning process parameters provided in advance for the version 4. In the structure of this embodiment, however, the printer driver of version 4 may carry out the color conversion and halftoning processes corresponding to the versions 1 to 3 according to the requirements. In one possible application, the printer driver includes color conversion tables and halftoning process parameters corresponding to the versions 1, 2, and 3 and selectively uses the required tables and parameters to change over the processing mode. The printer driver 50A has a processing mode changeover module 52 to select a desired processing mode among a plurality of optional processing modes. The other configuration is identical with that of the first embodiment.

Figure 7:
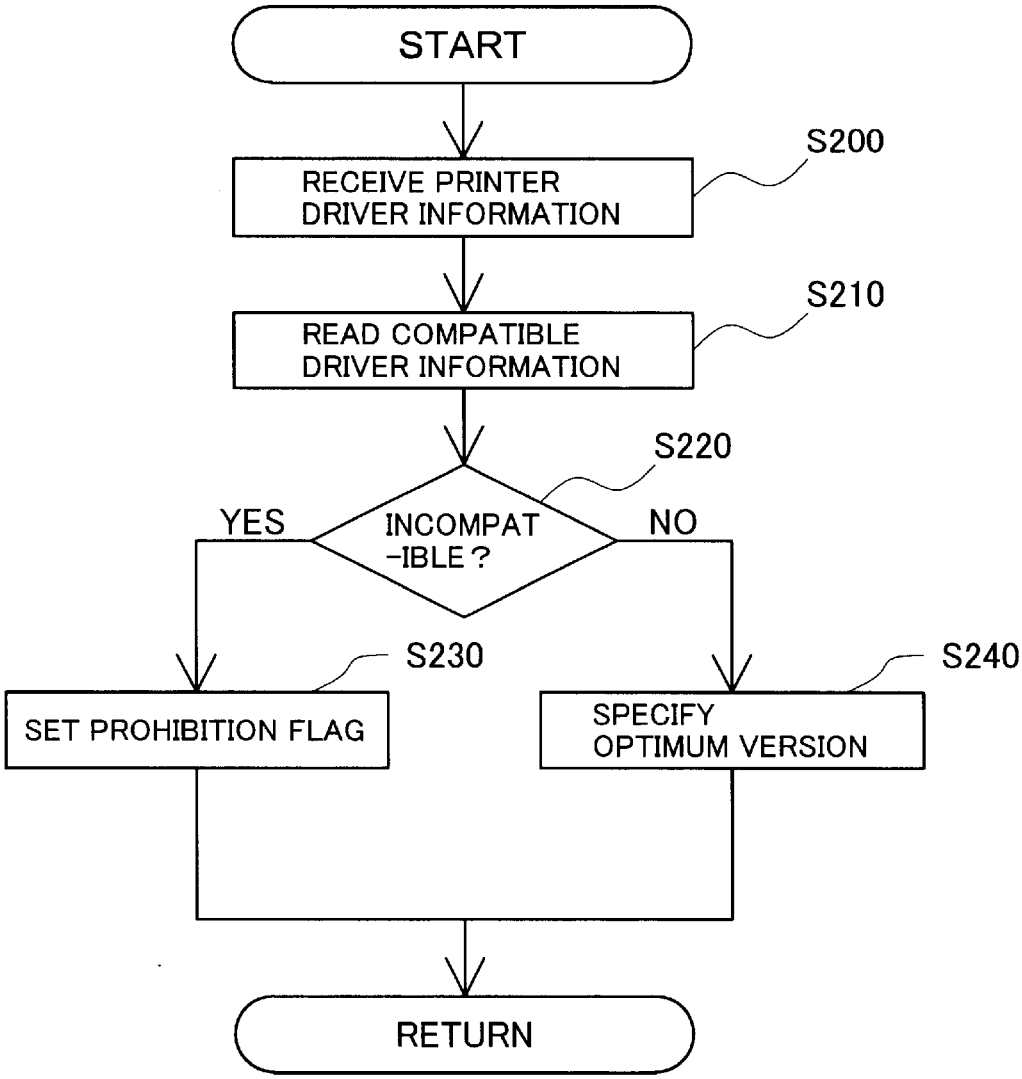
FIG. 7 is a flowchart showing a routine of determining the compatibility of the ink cartridge 100 with the printer (printer driver) executed in the second embodiment.

FIG. 7 is a flowchart showing a routine of determining the compatibility of the ink cartridge 100 with the printer (printer driver) executed in the second embodiment. Like the first embodiment, a controller 90A in the printer PRT executes this processing routine when the ink cartridge 100 is attached to the carriage 200.

The CPU first receives the printer driver information stored in the EEPROM 92 of the printer PRT (step S200), and reads the compatible driver information from the storage element 80 included in the ink cartridge 100 (step S210). The CPU then collates the printer driver information with the compatible driver information and determines whether or not the current combination is incompatible (step S220).

In the case of 'incompatible', the CPU displays the 'incompatible' level, requires the user to replace the ink cartridge or update or change the printer driver, and sets the prohibition flag in the EEPROM 92 (step S230).

In the case of not 'incompatible', on the other hand, the CPU specifies the optimum version of the printer driver and stores the specified version of the printer driver into the EEPROM 92 (step S240).

The processing at step S240 is described concretely with the compatible driver information shown in FIG. 4. For example, it is here assumed that the printer driver A of version 4 is installed. In this case, the CPU retrieves the compatible driver information to find any version of the printer driver A having the higher compatibility with the ink cartridge than the version 4 among the lower versions of the printer driver A than the version 4. In the example of FIG. 4, the retrieval of the versions 1 through 3 shows that the version 3 has the higher compatibility than the version 4. The CPU accordingly stores the 'version 3' as the optimum version information into the EEPROM 92.

In another example, when the printer driver A of version 3 is installed, the retrieval of the lower versions 1 and 2 shows that there is no version having the higher compatibility than the version 3. The CPU accordingly stores the 'version 3' as the optimum version information into the EEPROM 92.

The retrieval to find any version having the higher compatibility is carried out only with regard to the lower versions, since the installed printer driver is not capable of carrying out the processing of any higher versions. For example, when the printer driver of version 2 is installed, the version 3 is not included in the range of retrieval. As the result of comparison between the versions 1 and 2, the 'version 2' is stored as the optimum version information.

The compatibility of the corresponding combination may not be present in the compatible driver information, because the version of the printer driver 50A is higher (for example, version 5) than those specified in the compatible driver information stored in the storage element 80. In the structure of this embodiment, the printer driver of version 5 is capable of carrying out the processing corresponding to the versions 1, 2, 3, and 4. The compatibility determination routine of this embodiment is thus applicable to such cases.

Figure 8:
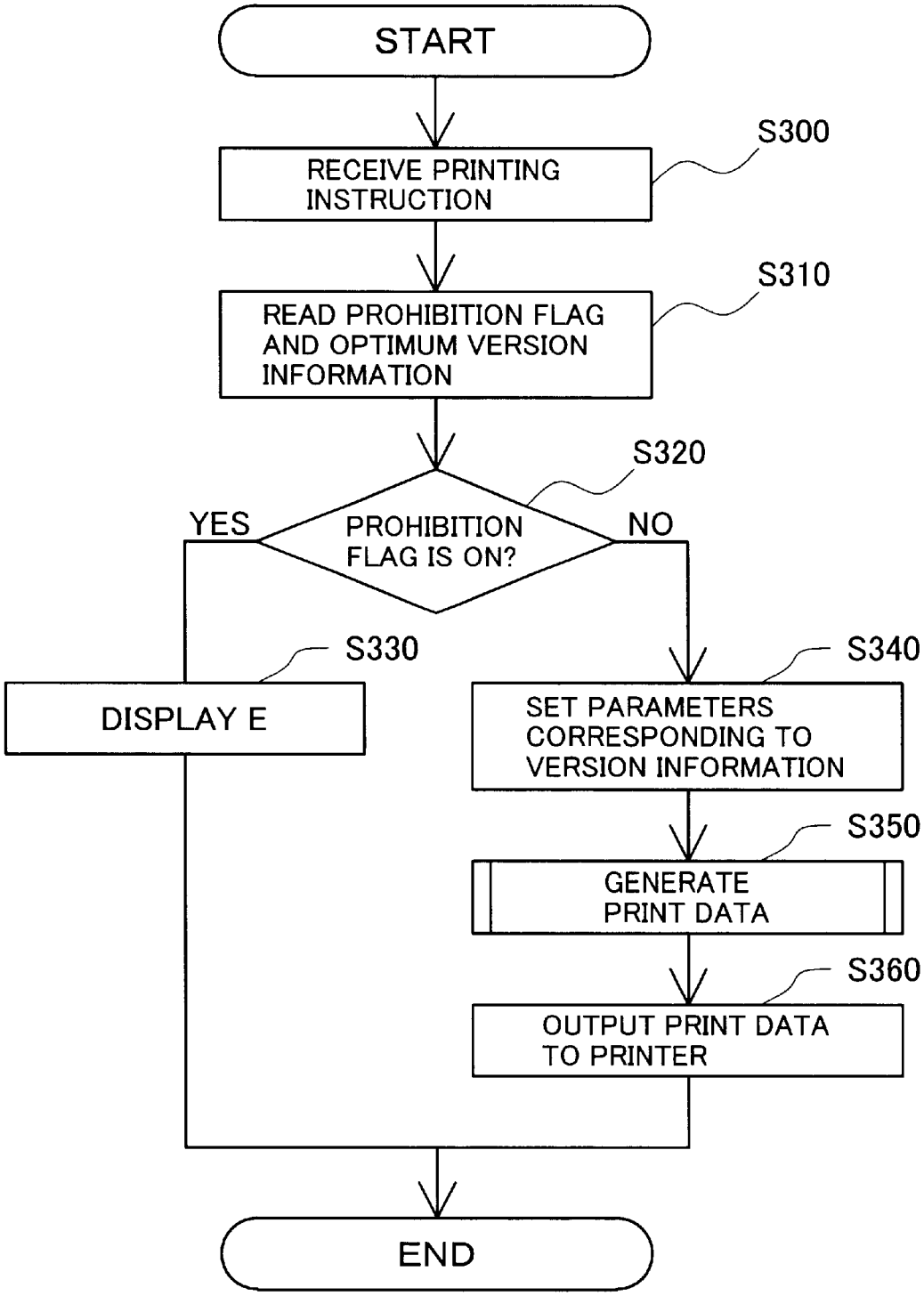
FIG. 8 is a flowchart showing a processing routine executed by a printer driver 50A in the course of printing operation.

In the course of printing operation, the processing mode changeover module 52A of the printer driver 50A selects the desired color conversion tables and parameters to change over the method of generating print data. FIG. 8 is a flowchart showing a processing routine executed by the printer driver 50A in the course of printing operation. In response to a printing instruction (step S300), the printer driver 50A reads the prohibition flag stored in the EEPROM 92 and the optimum version information specified at the time of attachment of the ink cartridge (step S310), and specifies the setting status of the prohibition flag (step S320). In the case of setting of the prohibition flag, the printer driver 50A gives a display E showing that the currently attached ink cartridge is incompatible and requires the user to replace the ink cartridge or to update or change the printer driver (step S330). In this case, the program exits from this processing routine without the actual printing operation. In the case of non-setting of the prohibition flag, on the other hand, the printer driver 50A changes over the diverse parameters used for generating the print data to those corresponding to the optimum version information and sets the corresponding parameters (step S340). The printer driver 50A subsequently generates print data by the procedure corresponding to the version specified by the optimum version information (step S350) and outputs the generated print data to the printer PRT (step S360).

As discussed above, in the structure of the second embodiment, the ink cartridge 100 stores the compatible driver information. The controller in the printer reads the compatible driver information and collates the compatible driver information with the installed printer driver information, so as to determine the compatibility of the ink cartridge with the printer. This arrangement effectively prevents the potential troubles due to the incompatible combination of the ink cartridge with the printer driver. The printer driver 50A selectively changes over the method of generating print data corresponding to the ink cartridge, thus enhancing the picture quality of the printed images.

E. Third Embodiment

Figure 9:
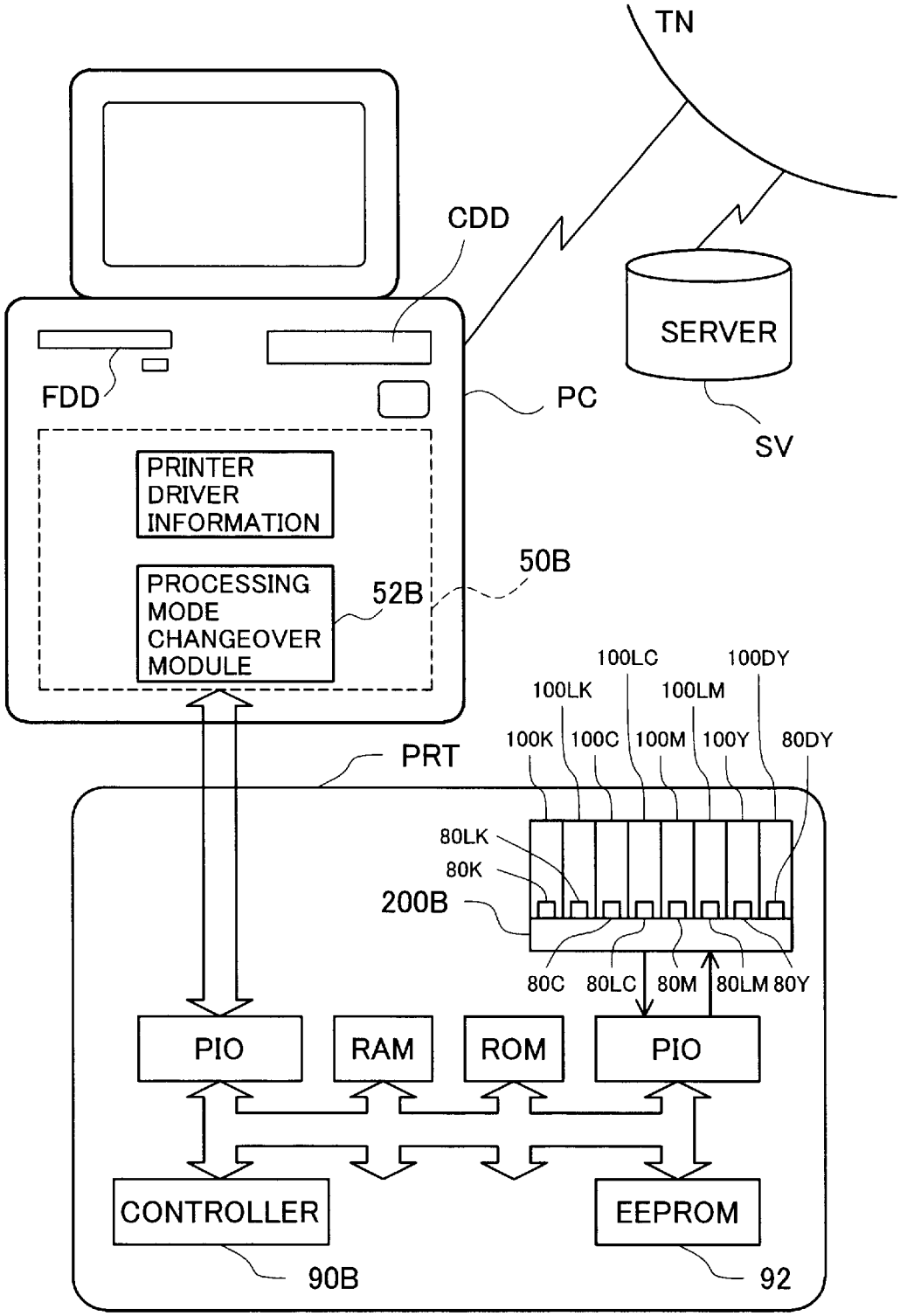
FIG. 9 is a block diagram illustrating the structure of still another printing system in a third embodiment of the present invention.

FIG. 9 is a block diagram illustrating the structure of still another printing system in a third embodiment of the present invention. The main construction is similar to that of the second embodiment. The printer PRT of the third embodiment has a carriage 200B to which eight ink cartridges, each keeping one ink, are attachable. As illustrated, for example, a black ink cartridge 100K, a light black ink cartridge 100LK, a cyan ink cartridge 100C, a light cyan ink cartridge 100LC, a magenta ink cartridge 100M, a light magenta ink cartridge 100LM, a yellow ink cartridge 100Y, and a dark yellow ink cartridge 100DY are attachable to the carriage 200B. Dark yellow ink has the lower lightness than that of yellow ink. These ink cartridges respectively have storage elements 80K, 80LK, 80C, 80LC, 80M, 80LM, 80Y, and 80DY. The user can arbitrarily select a combination of ink cartridges attached to the carriage, among these ink cartridges. Ink cartridges other than the ink cartridges 100K through 100DY, for example, newly developed ink cartridges with storage elements, may also be attached to the carriage.

Like the printer driver 50A of the second embodiment, a printer driver 50B keeps multiple color conversion tables and halftoning process parameters. A processing mode changeover module 52B selects a desired processing mode among multiple processing modes to generate print data. The printer driver 50B is the up-to-date printer driver provided by the printer manufacturer.

FIG. 10 shows an exemplified data array in the storage element 80C included in the cyan ink cartridge 100C. The other storage elements have similar data arrays, though not specifically illustrated. The memory cell of the storage element 80C has a first area 240C in which read only memory is stored and a second area 230C in which rewritable data is stored.

As illustrated, the first area 240C stores therein color information showing that the ink kept therein is cyan ink, ink type data as the ink composition information, and other pieces of information with regard to the ink cartridge 100C, and compatible driver information. The compatible driver information in this embodiment is discussed below.

The second area 230C stores remaining quantity data of cyan ink. Two storage spaces are allocated to the remaining quantity data of the ink. The remaining quantity data of the ink is alternately written into these two storage spaces.

FIG. 11 shows an example of the contents of the compatible driver information in this embodiment. The compatible driver information stores the compatibility of various combinations of ink cartridges attached to the carriage shown as SET1, SET2, SET3 with diverse versions of a printer driver in the form of a table. Like the table of FIG. 4, in the table of this embodiment, the compatibility is expressed by four levels 'optimum', 'compatible', 'allowed', and 'incompatible'. The table shown in FIG. 11 is provided for each type of the printer PRT.

The symbols K, LK, C, LC, M, LM, Y, and DY in the table respectively represent the black ink cartridge 100K, the light black ink cartridge 100LK, the cyan ink cartridge 100C, the light cyan ink cartridge 100LC, the magenta ink cartridge 100M, the light magenta ink cartridge 100LM, the yellow ink cartridge 100Y, and the dark yellow ink cartridge 100DY. The symbol K2 represents a newly developed black ink cartridge 100K2.

In the description of this embodiment, it is assumed that the ink cartridges have been developed in the order of (1) to (4):

(1) ink cartridges 100K 100C, 100LC, 100M, 100LM, and 100Y (2) ink cartridge 100DY (3) ink cartridge 100LK (4) ink cartridge 100K2

In the example of FIG. 11, on first sale, only the compatible driver information corresponding to SET1 is recorded in the cyan ink cartridge 100C. The cyan ink cartridge 100C manufactured after completion of the development (2) has the compatible driver information corresponding to SET2 that reflects the development, in addition to SET1. The compatible driver information is occasionally added according to the timing of development and manufacture of the ink cartridge. The printer driver of this embodiment carries out the printing operation even with previously manufactured ink cartridges, so that the previous compatible driver information like SET1 is not deleted but remains.

The compatible driver information is stored in the storage elements included in the respective color ink cartridges. The eight ink cartridges are attachable to the printer PRT of the embodiment, so that part of the compatible driver information is stored in these storage elements in an overlap manner.

As mentioned previously, the compatible driver information is occasionally added according to the timing of manufacture. The ink cartridge of the latest year, month, and date of manufacture stores the most comprehensive, up-to-date compatible driver information. It is accordingly not required to refer to all the compatible driver information stored in each of the ink cartridges attached to the carriage. It is sufficient to read the compatible driver information from the ink cartridge of the latest year, month and date of manufacture.

Figure 12:
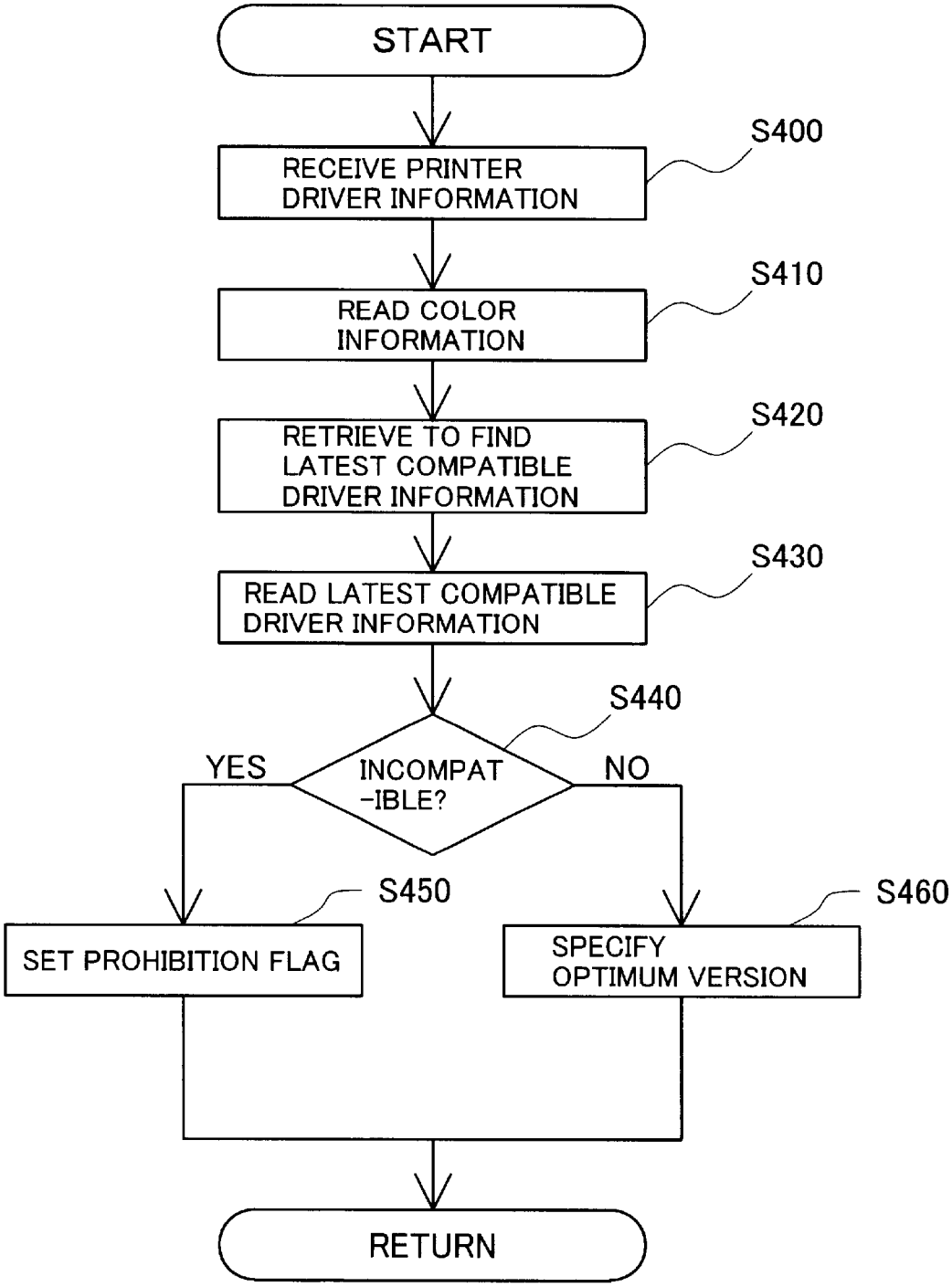
FIG. 12 is a flowchart showing a routine of determining the compatibility of multiple ink cartridges with the printer driver.

FIG. 12 is a flowchart showing a routine of determining the compatibility of multiple ink cartridges with the printer driver. A CPU in a controller 90B of the printer PRT executes this processing routine when all the eight ink cartridges are attached to the corresponding places on the carriage 200B.

The CPU first receives the printer driver information stored in the EEPROM 92 of the printer PRT (step S400), and reads the color information from the respective storage elements included in the eight ink cartridges attached to the carriage (step S410). The CPU then carries out retrieval to find the newest ink cartridge among the eight ink cartridges (step S420). The retrieval of the newest ink cartridge is carried out by referring to the version data of the respective ink cartridges stored in the storage elements of the ink cartridges. The CPU subsequently reads the latest compatible driver information from the storage element included in the retrieved newest ink cartridge (step S430). The CPU collates the input printer driver information with the compatible driver information with regard to the current combination of the eight ink cartridges and determines whether or not the current combination is incompatible (step S440).

In the case of 'incompatible', the CPU gives a display representing the 'incompatible' level, requires the user to replace the ink cartridge or to update or change the printer driver, and sets the prohibition flag in the EEPROM 92 (step S450).

In the case of not 'incompatible', on the other hand, the CPU specifies the optimum version of the printer driver and stores the specified version of the printer driver into the EEPROM 92 (step S460).

The processing at step S460 follows the procedure discussed in the second embodiment. The processing mode changeover module 52B of the printer driver 50B executes the same series of processing as the processing discussed in the second embodiment.

As described above, the procedure of the third embodiment specifies the optimum printer driver corresponding to the combination of ink cartridges attached to the printer PRT, to which multiple ink cartridges, each keeping one ink, are attachable. This arrangement enables the compatibility of the ink cartridge with the printer or the printer driver to be determined flexibly with high accuracy. The printer driver 50B adequately changes over the method of generating print data according to the combination of ink cartridges, thus enhancing the printing quality.

The printing apparatuses of the embodiments discussed above include the series of processing executed by the computer. Another embodiment of the present invention is thus a recording medium in which computer programs for actualizing the processing are recorded. Typical examples of the recording medium include flexible disks, CD-ROMs, magneto-optic discs, IC cards, ROM cartridges, punched cards, prints with barcodes or other codes printed thereon, internal storage devices (memories like a RAM and a ROM) and external storage devices of the computer, and a variety of other computer readable media.

F. Modifications

The above embodiments and their applications are to be considered in all aspects as illustrative and not restrictive. There may be many modifications, changes, and alterations without departing from the scope or spirit of the main characteristics of the present invention. Some examples of possible modification are given below.

F1. Modified Example 1

The procedure of any of the above embodiments determines the compatibility of the ink cartridge with the printer driver. The present invention is, however, not restricted to this procedure. In general, the technique of the present invention is applied to determine the software compatibility of the ink cartridge with the printing apparatus. One modified example thus stores information of the compatible firmware in the storage element included in the ink cartridge and determines the compatibility of the ink cartridge with the firmware of the main body.

F2. Modified Example 2

In the structure of any of the above embodiments, in order to determine the software compatibility of the ink cartridge with the printing apparatus, the information on compatible printer drivers is stored in the storage element included in the ink cartridge. Storage of additional information on the compatible printing apparatus (hardware) also enables determination of the hardware compatibility. A dedicated printer driver is generally provided for each type of the printing apparatus. There is, however, a possibility that the printer driver for another type is mistakenly adopted. The modified example 2 determines whether or not the appropriate printer driver is used for the printing apparatus at the time of attachment of the ink cartridge.

F3. Modified Example 3

In any of the above embodiments, the determination of compatibility is performed at the time of attachment of the ink cartridge. The determination of compatibility may alternatively be carried out at the time of first communication with the printer PRT after installation of the printer driver into the computer PC. The printer driver, instead of the printer main body, may carry out the determination of compatibility.

F4. Modified Example 4

In all the above embodiments, the compatible driver information is stored in the storage element included in the ink cartridge. This place of storage is, however, not restrictive. The compatible driver information may otherwise be stored in a ROM or an EEPROM in the printer PRT, in a storage module in the printer driver, or in a server on the network.

What is claimed is:

1. An ink cartridge attachable to a printing apparatus, said ink cartridge comprising:

a storage element that stores therein compatible driver information, which is used to specify a printer driver compatible with said ink cartridge, wherein the compatible driver information expresses compatibility of said ink cartridge with multiple printer drivers in a stepwise manner.

2. An ink cartridge in accordance with claim 1, wherein the compatible driver information includes version information of the printer driver.

3. An ink cartridge in accordance with claim 1, wherein the compatible driver information includes prohibition information to specify at least one of a printing apparatus and a printer driver, for which use of said ink cartridge is prohibited.

4. An ink cartridge in accordance with claim 1, wherein the compatible driver information stores a mapping of said ink cartridge to multiple printer drivers with regard to each printing apparatus.

5. An ink cartridge in accordance with claim 1, said ink cartridge keeping one ink, wherein said storage element further stores therein ink specification information, which is used to specify the ink kept in said ink cartridge.

6. An ink cartridge in accordance with claim 5, wherein the ink specification information includes color information of the ink.

7. An ink cartridge in accordance with claim 5, wherein the ink specification information includes composition information of the ink.

8. An ink cartridge in accordance with claim 5, wherein said printing apparatus is capable of receiving a plurality of said ink cartridges attached thereto, and the compatible driver information specifies a printer driver corresponding to a combination of ink cartridges attached to said printing apparatus.

9. A printing apparatus that records an image on a printing medium, said printing apparatus comprising:

a main body storage unit that stores therein printer driver information, which is applied to specify a printer driver used for printing;

an input module that reads a predetermined piece of information from a storage element included in an ink cartridge attached to said printing apparatus; and a compatibility determination module that collates the input information with the printer driver information stored in said main body storage unit and determines compatibility of said ink cartridge with the printer driver.

10. A printing apparatus in accordance with claim 9, wherein said main body storage unit further stores compatible driver information, which is used to specify a printer driver compatible with said ink cartridge, and said compatibility determination module carries out the determination, based on the compatible driver information.

11. A printing apparatus in accordance with claim 9, wherein said printing apparatus is capable of receiving a plurality of said ink cartridges attached thereto, said input module reads the predetermined piece of information from each of storage elements included in said plurality of ink cartridges, and said compatibility determination module carries out the determination, based on a combination of the predetermined piece of information.

12. A print control apparatus that processes master image data and thereby generates print data, which causes a printer to print an image, said print control apparatus comprising:

an input module that reads a predetermined piece of information from a storage element included in an ink cartridge attached to said printer; and a processing control module that changes over a method of generating the print data, based on the input information.

13. A print control apparatus in accordance with claim 12, wherein said printer is capable of receiving a plurality of said ink cartridges attached thereto, said input module reads the predetermined piece of information from each of storage elements included in said plurality of ink cartridges, and said processing control module carries out the changeover, based on a combination of the predetermined piece of information.

14. A method of controlling a printing apparatus that records an image on a printing medium, said method comprising the steps of:

(a) receiving printer driver information, which is applied to specify a printer driver used for printing;

(b) reading a predetermined piece of information from a storage element included in an ink cartridge attached to said printing apparatus; and (c) collating the input information with the printer driver information to specify adequacy of printing.

15. A method in accordance with claim 14, wherein the input information includes prohibition information to specify either of a printing apparatus and a printer driver, for which use of said ink cartridge is prohibited, and said step (c) comprises the step of prohibiting operation of said printing apparatus when the prohibition information is coincident with the printer driver information.

16. A print control method that processes master image data and thereby generates print data, which causes a printer to print an image, said print control method comprising the steps of:

(a) reading a predetermined piece of information from a storage element included in an ink cartridge attached to said printer; and (b) changing over a method of generating the print data, based on the input information.

17. A recording medium in which a computer program for controlling a printing apparatus that records an image on a printing medium is recorded in a computer readable manner, said computer program causing a computer to attain the functions of:

receiving printer driver information, which is applied to specify a printer driver used for printing;

reading a predetermined piece of information from a storage element included in an ink cartridge attached to said printing apparatus; and collating the input information with the printer driver information to specify adequacy of printing.

18. A recording medium in which a computer program for processing master image data and thereby generating print data, which causes a printer to print an image, is recorded in a computer readable manner, said computer program causing a computer to attain the functions of:

reading a predetermined piece of information from a storage element included in an ink cartridge attached to said printer; and changing over a method of generating the print data, based on the input information.

* * * * *